United States Patent [19]

Ogawa et al.

[11] Patent Number: 4,588,280

[45] Date of Patent: May 13, 1986

[54] IMAGE FORMING APPARATUS AND PROCESS UNIT DETACHABLY MOUNTABLE THERETO

[75] Inventors: Hiroshi Ogawa; Mototada Toriumi; Shigeyoshi Onoda, all of Yokohama, Japan

[73] Assignee: Canon Kabushiki Kaisha, Tokyo, Japan

[21] Appl. No.: 521,835

[22] Filed: Aug. 10, 1983

[30] Foreign Application Priority Data

Aug. 17, 1982 [JP] Japan ..... 57-143105
Aug. 23, 1982 [JP] Japan ..... 57-145817

[51] Int. Cl.[4] ..... G03G 15/00
[52] U.S. Cl. ..... 355/3 R
[58] Field of Search ..... 355/3 R, 3 DR, 133, 355/8, 11

[56] References Cited

U.S. PATENT DOCUMENTS 3,985,436 10/1976 Tanaka et al. ..... 355/8
4,270,856 6/1981 Goida ..... 355/3 R
4,462,677 7/1984 Onoda ..... 355/3 R
4,470,689 9/1984 Nomura et al. ..... 355/3 R

*Primary Examiner*—R. L. Moses
*Attorney, Agent, or Firm*—Fitzpatrick, Cella, Harper & Scinto

[57] ABSTRACT

A process unit detachably mountable into an image forming apparatus has all or a part of image forming process means, and an image forming apparatus using the same. The process unit includes an image bearing member, process devices actable on the image bearing member a casing for containing the image bearing member and process devices, the casing being provided with an aperture for allowing the image bearing member to be exposed to light, and a cover movable between a closing position wherein the cover closes the aperture and a retracted position wherein the cover is retracted from the closing position, in response to mounting of the unit into, and demounting of the unit, from the image forming apparatus. The image forming apparatus may have a device for moving the cover in response to the mounting or demounting of the unit.

21 Claims, 21 Drawing Figures

IMAGE FORMING APPARATUS AND PROCESS UNIT DETACHABLY MOUNTABLE THERETO

BACKGROUND OF THE INVENTION

1. Field of the Invention

The present invention relates to a process unit which contains an image bearing member and all or a part of process means which acts on the image bearing member, and which is detachably mountable to a main body of an apparatus, and also to an image forming apparatus using such a process unit.

2. Description of the Prior Art

The prior art will be described with respect to an electrophotographic copying apparatus, as an example of the image forming apparatus.

Conventionally, electrophotographic machines require a trained and expert serviceman for replacement of a photosensitive member which is an image bearing member, supply of the developer, disposal of the used developer, cleaning of charging wires, replenishment and adjustment of various parts and so on. It is needed that the serviceman goes to offices having the electrophotographic machines, whenever the servicing is necessary. This is disadvantageous both for machine makers and machine users, since the makers have to establish and maintain the servicing network to meet the demand, and the users have to wait for the serviceman to arrive before the restart of the machine operation.

To remove those disadvantages, it is recently proposed, as disclosed in U.S. Pat. No. 3,985,436, that various process means, such as a photosensitive member, a developing device, a cleaning means and a charger are all contained in a casing as a unit, and that the unit is replaced with a fresh unit when the unit set in the machine is no longer usable, so that all the means contained therein are exchanged simultaneously, thus saving the machine servicing operation. This makes it possible for users to replace various elements without resort to an expert serviceman and eliminates the necessity of periodical maintenance work. Also, the serviceman's job can be tremendously reduced. Additionally, the process unit can contain a developer of a different color, which allows for the users to take a copy with the different color. Another process unit can replace to use the type of developing means which suits the original to be copied. Those are additional advantages.

However, this type of process unit involves a problem that, when the unit is replaced, or when the unit is kept out of the image forming apparatus, the photosensitive member contained in the process unit is possibly stained by a hand of the user, or the photosensitive member is possibly damaged mechanically or physically, if it is partly exposed. In addition, the photosensitive layer of zinc oxide, selenium or organic photoconductor (opc), which constitutes the image bearing member in the process unit, may be deteriorated, when it is exposed to the external light. The stain, damage or deterioration will adversely affect the image formed by the image forming apparatus with the process unit.

The process unit is relatively frequently placed into or out of the image forming apparatus during its service life, since it is replaced with another unit of different color copy, for example, as described hereinbefore, so that it is desirable to ensure the protection of the photosensitive member.

SUMMARY OF THE INVENTION

The principal object of the present invention is to provide a process unit or an image forming apparatus using the process unit, the unit containing the image bearing member which is protected from the possible stain and damage, when not in use or when it is exchanged with another process unit.

Another object of the present invention is to provide a process unit or an image forming apparatus using the process unit, the unit containing the image bearing member which is protected from possible deterioration by external light, when not in use or when it is exchanged with another process unit.

A further object of the present invention is to provide a process unit or an image forming apparatus using the process unit, wherein the image bearing member in the process unit is protected enough to provide at all times a sharp image.

Further objects, details and advantages of this invention will be apparent from the accompanying drawings and following description of a preferred embodiment.

DESCRIPTION OF THE PREFERRED EMBODIMENTS

Preferred embodiments of the present invention will now be described in conjunction with the accompanying drawings. The description will be made with respect to an electrophotographic copying apparatus as an example of the image forming apparatus of the present invention.

Figure 1:
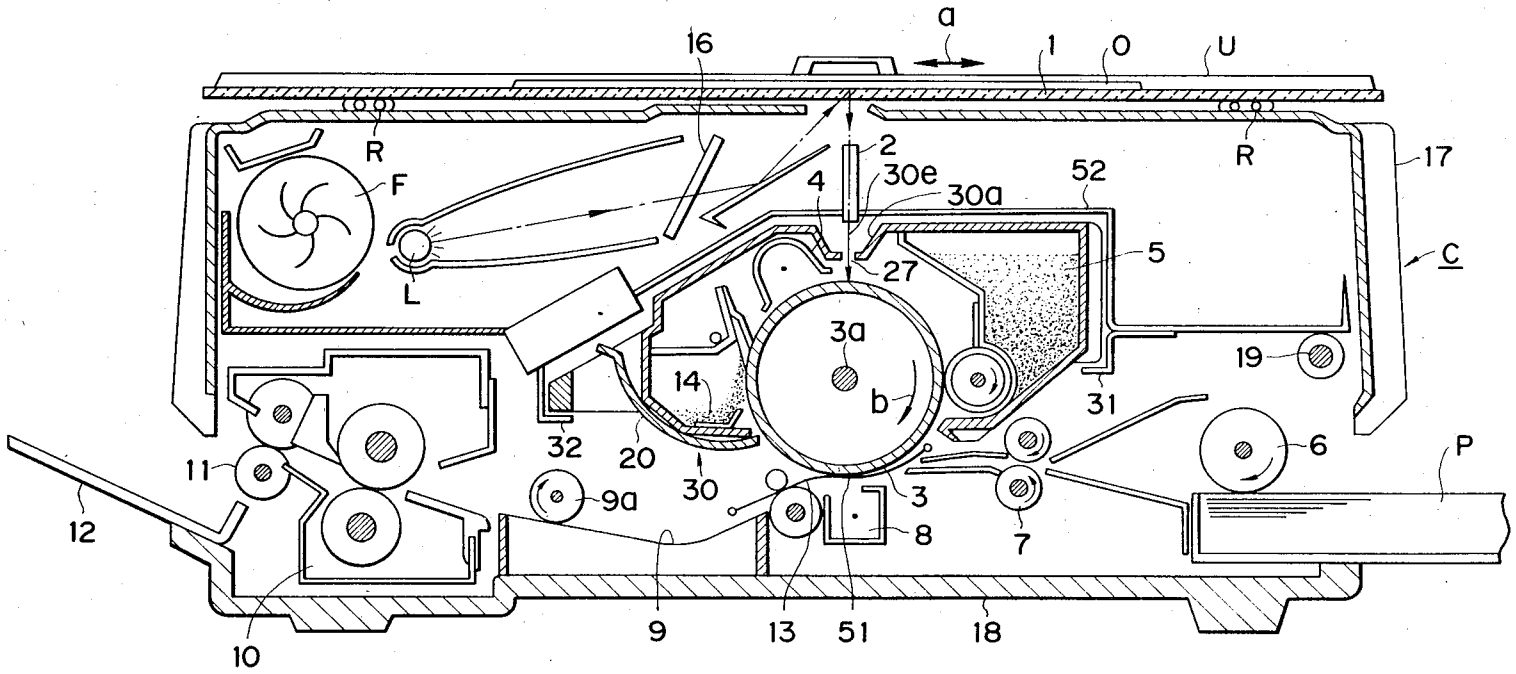
FIG. 1 shows a copying apparatus according to an embodiment of the present invention.
Figure 2:
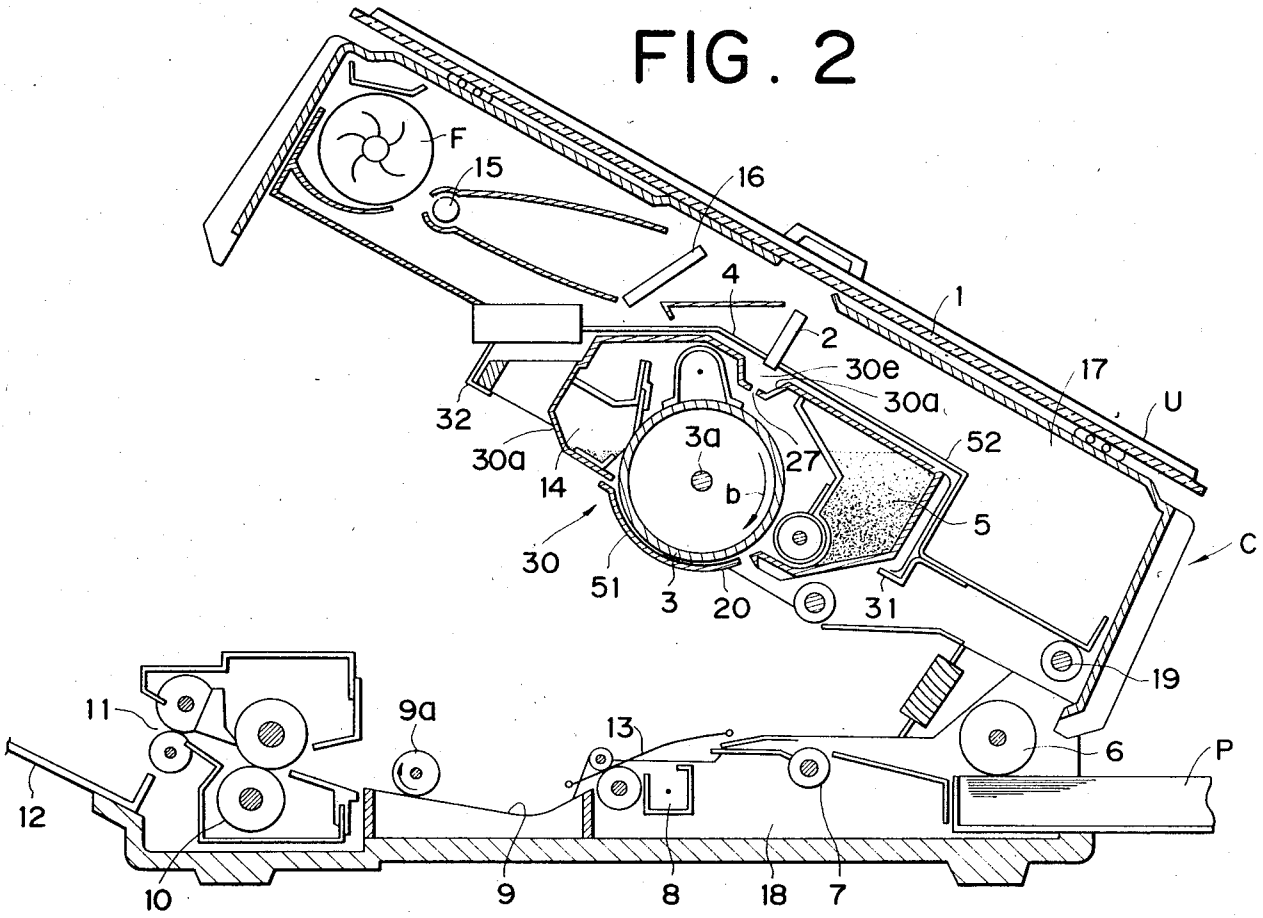
FIG. 2 shows the copying apparatus of FIG. 1 in a different state.

FIG. 1 illustrates a cross-section of a copying apparatus according to an embodiment of the present invention. FIG. 2 shows the same apparatus in a different state, wherein the copying apparatus is opened which will be described in detail hereinafter.

The copying apparatus of FIG. 1 includes a copyboard 1 for carrying an original to be copied, the copyboard 1 is made of a transparent material like glass. The copyboard 1 reciprocates on the rail R in the directions shown by arrow a. Under the copyboard 1, there is provided an array of image forming elements 2, which is effective to project through a slit an image of the original 0 to be copied placed on the copyboard 1, in a focussed state, onto the surface of photosensitive drum 3 having a organic photoconductor (opc). The original is illuminated by a lamp L. The optical path from the lamp to the photosensitive drum 3 is depicted by the reference numeral 15. The photosensitive drum 3 is rotatable in the direction shown by arrow b. The photosensitive drum 3 is electrically charged by a corona charger 4 which is effective to uniformly charge the photosensitive drum 3. The photosensitive drum 3, which is uniformly charged by the charger 4, is then exposed to the light image through the array 2 to form an electrostatic latent image thereon, which is in turn developed by a developing device 5.

A transfer sheet P, onto which the thus developed image is to be transferred is fed toward the photosensitive drum 3 by the feeding roller 6 and the register roller 7, and receives the toner image from the photosensitive drum 3 with the aid of the transfer corona charger 8. The transfer sheet P is then separated from the photosensitive drum 3 by the separating means 13 and transported along a guide 9 by a roller 9*a* which is disposed at a lateral end, to fixing means 10 where the toner image on the transfer sheet P is fixed. The sheet P is then discharged out of the apparatus onto a tray 12.

On the other hand the toner which has remained on the photosensitive drum 3 is removed and collected by the cleaner 14. The apparatus further includes a copyboard cover U for pressing the original to the copyboard 1, a filter 16 for absorbing infrared light or others and a discharging fan. A shield 52 is fixedly provided to block the light and located at such a position that a process unit, which will be described in detail hereinafter, is slightly spaced apart from the shield 52.

The copying apparatus is divisible into two parts, i.e., upper body 17 and the lower body 18 which are pivotably connected by the pin 19. The upper body is pivotable counterclockwise by a compressed spring S to open the copying apparatus, as shown in FIG. 2. The upper body 17 contains an illuminating optical system including the lamp L and the imaging element array 2, photosensitive drum 3, the developing means 5, the cleaning means 14, which are parts of the image forming process means. The lower body 18 contains the feeding roller 9, the transfer corona discharge 8, the separating means 13, the guide 9, the fixing means 10 and others along the path of the transfer sheet P.

In this embodiment of the present invention, the photosensitive drum 3 and the process means therearound such as the developing means 5, cleaning means 14 and the charger 4 and some others are all contained in a shielding wall 30*a* as a unit, to constitute a process unit 30. Because of this arrangement, when the photosensitive drum 30 is replaced with another one, all the process means that are contained in the unit 30 are also replaced with new ones. Thus, the maintenance servicing is much reduced and simplified. The process unit 30 is mounted into or demounted from the main body C of the copying apparatus, by sliding the process unit 30 along the guiding rails 31 and 32 provided in the main body. Upon this sliding movement, the process unit 30 is moved in the direction parallel to the axis of the photosensitive drum 30. The sliding wall 30*a* which constitutes an outer casing of the process unit 30, is effective to block the light and to support the process means around the photosensitive drum 30 with a predetermined precision.

Figure 3:
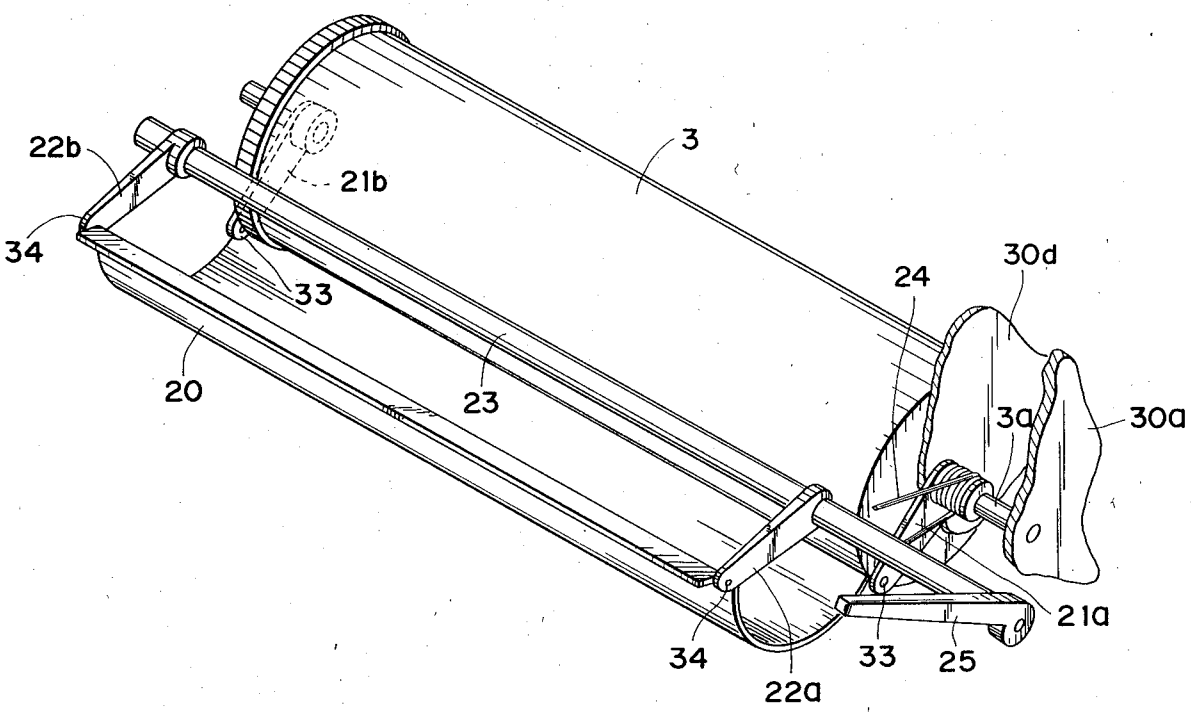
FIG. 3 is a partly broken perspective view of a drum cover operating mechanism of the copying apparatus of FIG. 1.

The casing 30*a* of the process unit 30 which is made of an opaque material such as an ABS resin is provided with an opening 51 at the bottom thereof, which exposes the photosensitive drum 3 to allow the transfer sheet P to access to the photosensitive drum 3 surface for the purpose of the image transfer action, when the process unit 30 is set in the image forming apparatus. In order to close the opening 51 with the view to blocking the light to the photosensitive drum 3 and protecting the same from the possible damage, when the process unit 30 is out of the image forming apparatus, a drum cover 20 is provided which is shown in detail in FIG. 3. As shown in FIG. 3, swingable arms 21*a* and 21*b* are journalled on the shaft 30*a* of the photosensitive drum 3 adjacent to the opposite ends of the photosensitive drum 3. To the other ends of the arms 21*a*, longitudinal ends of the drum cover 20 are pivotably supported by pins 33 at one lateral end of the cover 20. At the other lateral end of the drum cover 20, the longitudinal ends of the drum cover 20 are also pivotably supported by pins 34 to the additional swingable arms 22*a* which are rotatably supported on a shaft 23 which extends codirectionally with the drum shaft 3*a*. At an end of the shaft 23 a lever 25 is fixed. The arms 21*a* and 21*b* are urged counterclockwise by a spring 24. Designated by reference numeral 30*d* in FIG. 3 is a part of the inner casing of the process unit 30.

When the lever 25 is rotated clockwise by the mechanism which will be described hereinafter, the shaft 23 rotates clockwise to move the drum cover 20 through the swingable arms 22*a* and 22*b* to retract the drum cover 20 so that it retracts from the closing position, thus exposing the photosensitive drum 3.

Figure 4:
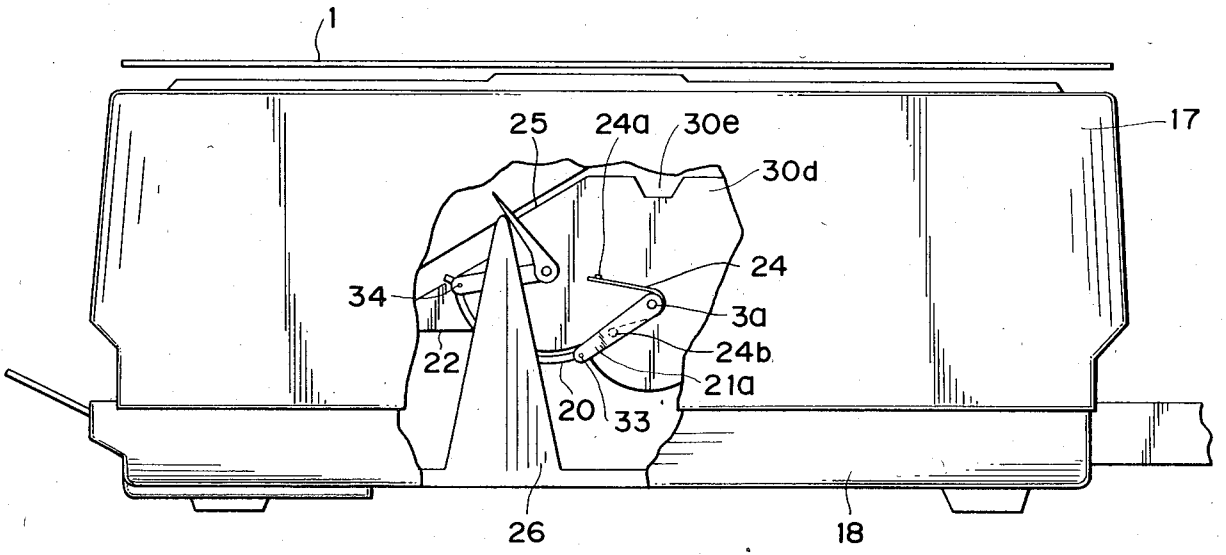
FIG. 4 is a partly broken front view of the copying apparatus of FIG. 1, showing the state wherein the process unit is set in the apparatus, and the drum cover is opened.

To automatically open the cover 20, the lower body 18 of the image forming apparatus has a fixed projection 26. When the process unit 30 is set in place in the image forming apparatus, and the upper body 17 is closed, the projection 26 pivots the lever 25 in the clockwise direction to retract the drum cover 20 from near the photosensitive drum 3 surface to uncover the drum opening 51 to expose the drum surface, thus enabling the image forming operation, as shown in FIG. 4.

Figure 5:
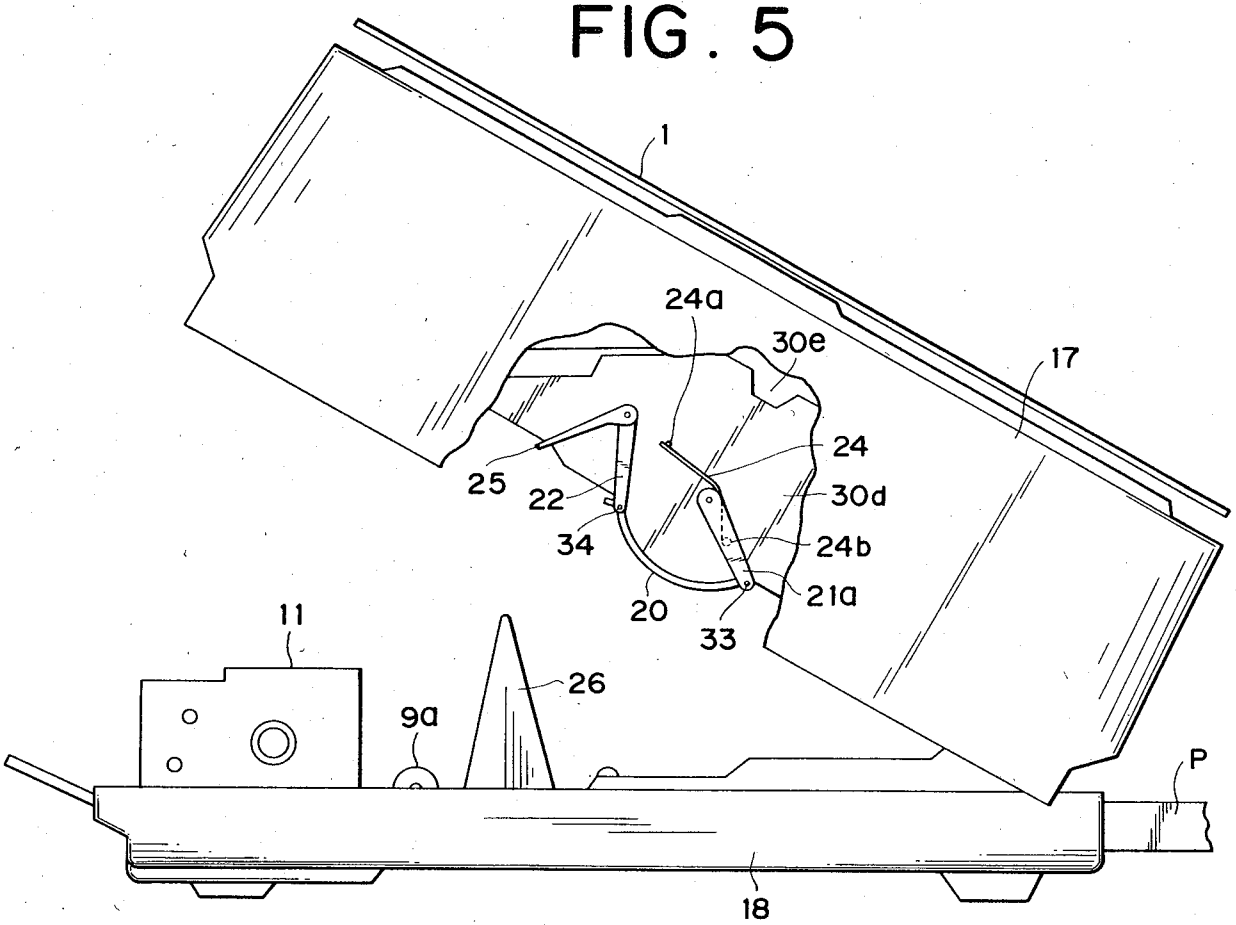
FIG. 5 is a partly broken front view of the copying apparatus of FIG. 1, showing the different state wherein the drum cover is opened.

When the upper body 17 is opened as shown in FIG. 5, the lever 25 disengages from the projection 26, the spring 24 having an end beared on a projection 24*a* formed on the inner casing 30*d* and the other end beared or a projection 24*b* formed on the arm 21*a*, pivots the swingable arms 21*a* and 21*b* in the counterclockwise direction to move the drum cover 20 to the neighbourhood of the drum 3 surface exposed, until it completely covers the opening 51. Thus, whenever the upper body 17 is opened, the cover 20 automatically closes the opening 51 to block the light otherwise entering the photosensitive drum 3, thus preventing the influence of the light to the photosensitive drum 3 and also preventing the possible mechanical or physical damage thereto.

In the foregoing embodiment, a part of the image forming apparatus is divisible, and the photosensitive drum 3 is shielded from the external light through the opening 51 which allows the image transfer operation, when the image forming apparatus is divided. The dividing is carried out, when the image forming apparatus is subjected to the maintenance servicing or when the transfer sheet P is jammed. So, at such times, the photosensitive drum 3 is protected from the external light without operator's paying attention to the protection.

The removal of the process unit 30 from the imaq.e forming apparatus will now be described. When it is to be taken out of the apparatus, it is first divided as shown in FIG. 2. Then, the process unit 30 is pulled outwardly along the guide rails 31 and 32 in the direction parallel to the drum shaft. It should be noted that the opening 51 has been closed by the drum cover 20 as described hereinbefore.

However, the process unit 30 has another opening. That is the image exposure aperture 27 formed in the casing 30*a* at the position opposing the imaging element array 2 to allow the image light to reach the photosensitive drum 3 surface when in use. Since the aperture 27 is near the surface of the photosensitive drum 3, the photosensitive drum 3 surface is readily influenced by the external light. For example, when the process unit 3 is taken out and left on a table for a while, the photosensitive drum 3 may come to have a light memory because of the natural light or other illuminating light existing around the table, which may reach the surface of the photosensitive drum 3 through the aperture 27. In addition, the surface may be damaged by something entering through the aperture 27. Further, foreign matters, such as dust, small pieces or the like, may enter and damage the surface of the photosensitive drum 3 during the subsequent image forming operation in which the photosensitive drum 3 rotates.

Figure 6:
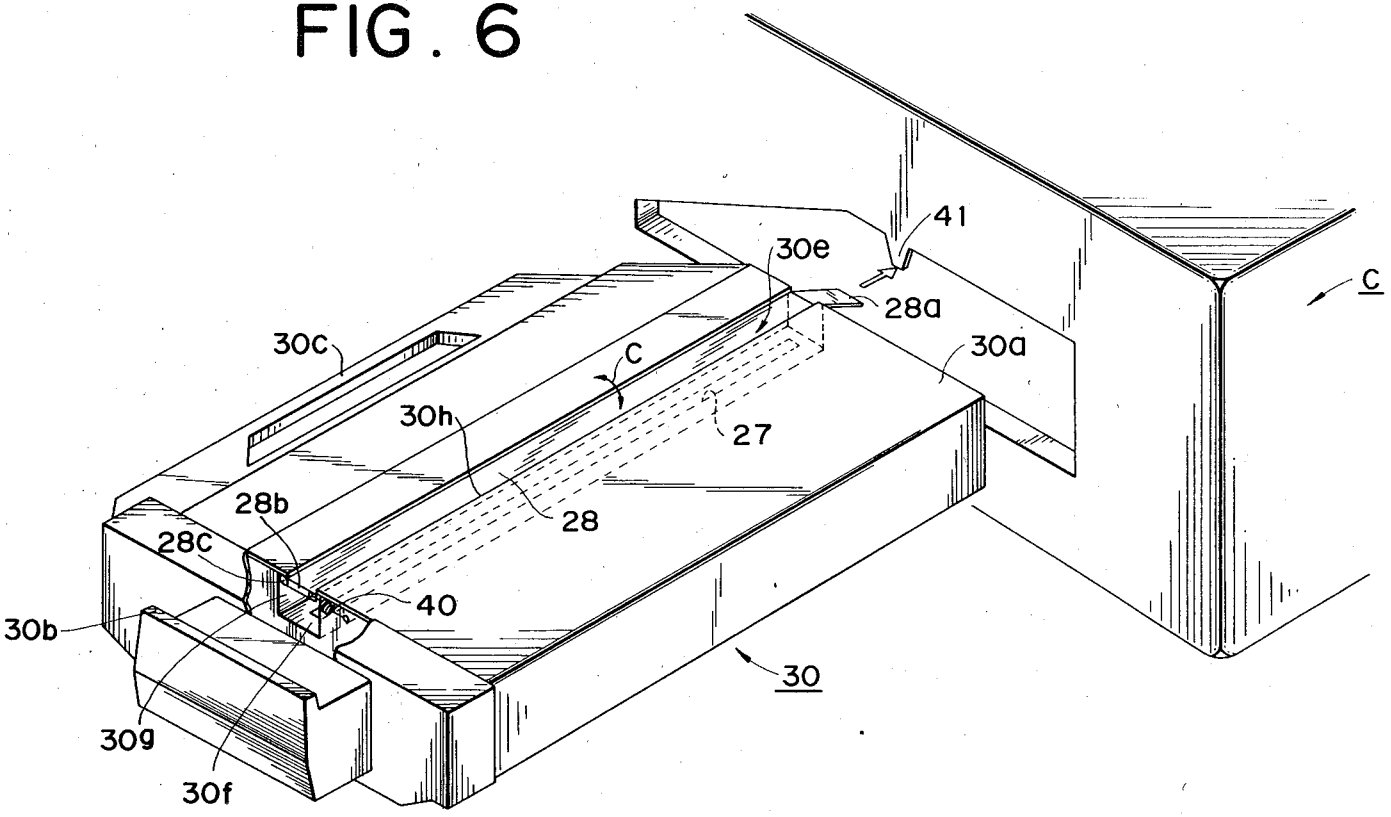
FIG. 6 is a partly broken perspective view, seen from the front, of the process unit used with the copying apparatus of FIG. 1.
Figure 7:
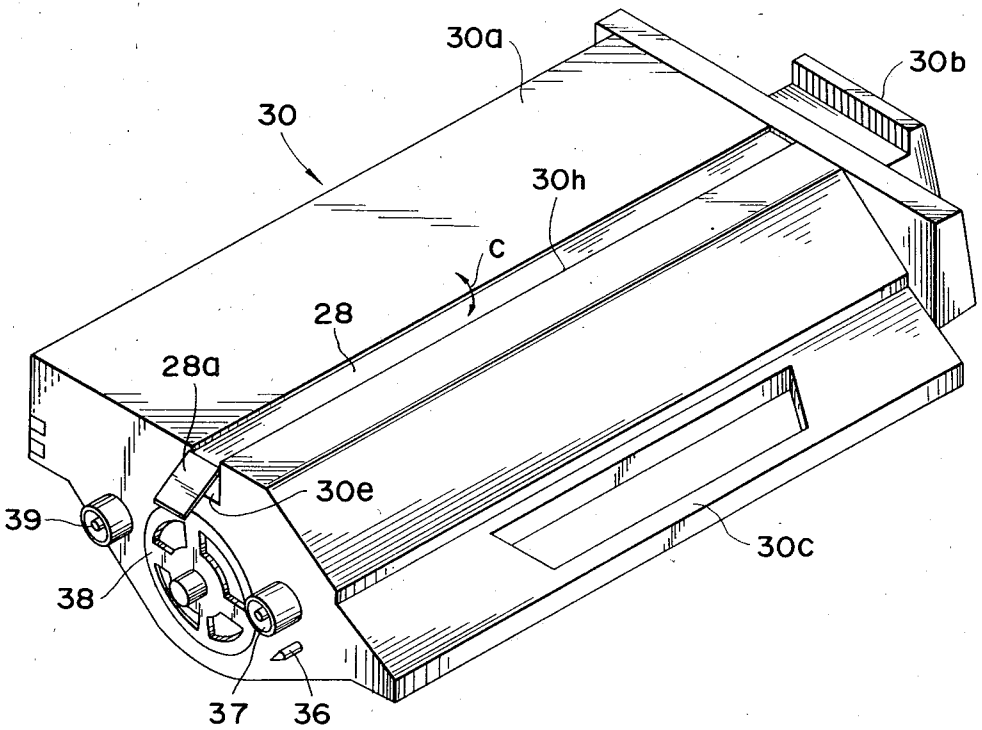
FIG. 7 is a perspective view, seen from the rear, of the process unit shown in FIG. 6.

To solve this problem, the aperture 27 is provided with a shield for blocking the light, which will be described in detail in conjunction with FIGS. 6 and 7. FIG. 6 shows a perspective view, seen from the upper front side, of the process unit 30 of an embodiment of the present invention, which has been taken out of the image forming apparatus body C. FIG. 7 shows a perspective view of the same seen from the upper rear side. The process unit 30 has a grip 30*b* for pulling the process unit 30 out of the image forming apparatus body C and another grip 30C for carrying the process unit 30.

As shown in FIG. 7, the process unit 30 has at its rear side an indexing pin 36 for mounting itself at a correct position in the image forming apparatus. Also, the process unit 30 has at the same side a connector 37 for supplying high voltage power to the corona charger 4 in the process unit 30, a gear 38 for transmitting the driving power from the image forming apparatus body C to the photosensitive drum 3 of the process unit 30 and a connector 39 for applying a bias voltage to the developing means 5. The gear 38 includes projected portions and adjacent recessed portions which are adapted to mesh with the recessed portions and projected portions of a gear, not shown, of the image forming apparatus.

The upper part of the wall 30*a* of the process unit 30 is provided with a recess 30*e* having a bottom 30*f*, in which an aperture 27 for the image light projection is formed. One of the side wall 30*g* of the recess 30*e* is provided with a shaft 28*c* at the upper portion thereof. To the shaft 28*c*, a cover or a shield 28 of a rigid material for blocking light is rotatably supported. The shield 28 has dimensions similar to that of the bottom 30*f* of the recess 30*e* to completely cover the upper opening 30*h* of the recess 30*e*. The shield 28 rotates as shown by arrow c in FIG. 6 in response to mounting and demounting of the process unit 30 into and out of the image forming apparatus body C.

Figure 8B:
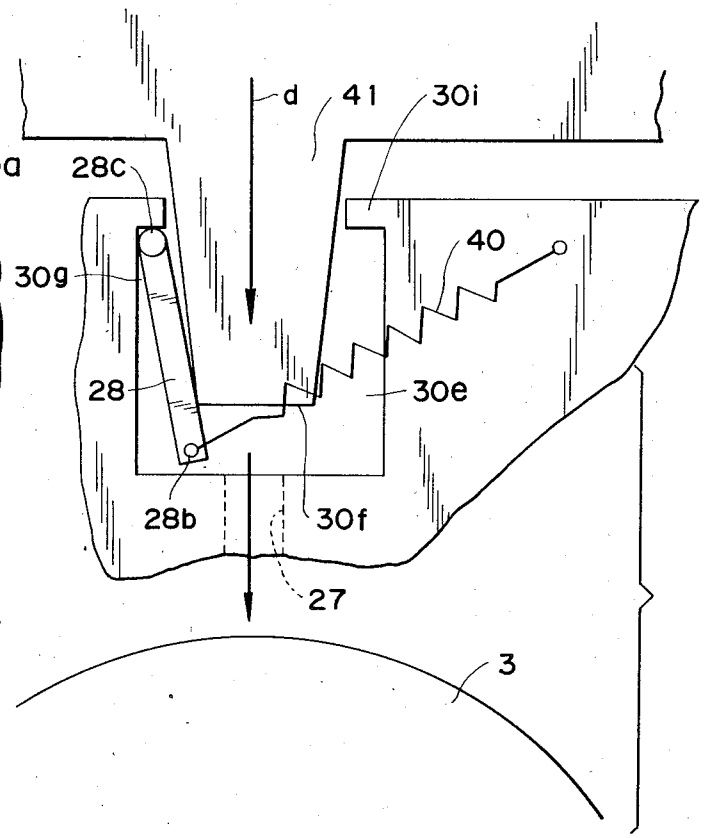
FIG. 8B shows a front view of the shielding plate in the opened state.
Figure 8A:
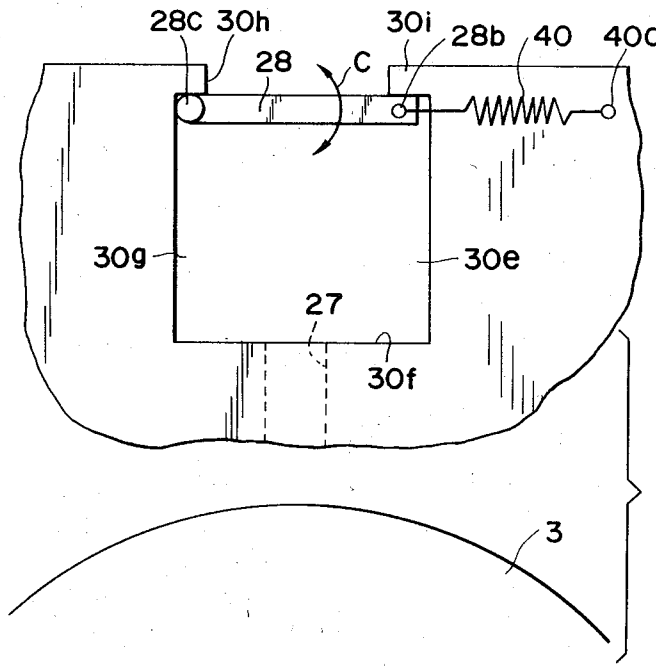
FIG. 8A shows a front view of a shielding plate in the closed state.

The action of the shield 28 will be described in detail in conjunction with FIGS. 8A and 8B, which show an enlarged front view of the process unit 30. The shield 28 is urged upwardly by a spring 40 having an end fixed to the process unit 30 body by a pin 40*a* and the other end fixed to that lateral end which is remote from the shaft 28, by a pin 28*b*, so that the opening 27 is closed thereby, when the process unit 30 is out of the main body C of the image forming apparatus. The pin 40*a* is located at the same level as, or at a higher level than, the pin 28*b* so that the force of spring 40 is effective to urge the shield 28 to the stopper 30*i*, thus closing the opening 30*h*. Therefore, any external light cannot enter through the aperture 23 so that the photosensitive drum 3 is shielded from the external light therearound. Thus, the possible occurrence of the light memory in the photosensitive drum 3 is prevented. It is also protected from a possibility of mechanical or physical damage to the photosensitive drum 3. Additionally, the foreign matter such as dust or the like cannot enter, through the opening.

The action of the shield 28 when the process unit 30 is mounted into the apparatus body C will now be described. The shield cover 28 has an integral tab 28*a*, at the rear side end, which is inclined downwardly away from the shield 28, as shown in FIGS. 6 and 7. The apparatus body C has a guiding projection 41 engageable with the tab 28*a*, as shown in FIG. 6. When, therefore, the process unit 30 is being mounted into the apparatus body C, the tab 28*a* engages to the guiding projection 41, as shown in FIG. 6, and with the insertion of the process unit 30, the shield 28 is pushed downwardly by the guiding projection 41 so that the shield 28 rotates in the clockwise direction about the shaft 28*c* as shown in FIG. 8B. Thus, when the process unit 30 is placed in the predetermined position in the apparatus body C, the aperture 27 opens as shown in FIG. 8B, so that the light from the imaging element array 2 can reach the photosensitive drum 3 to allow the imagewise exposure of the photosensitive drum 3.

When the process unit 30 is taken out of the image forming apparatus body C, the shield 28 returns to the horizontal position automatically by the spring 40 force to close the opening 27.

As for materials of the wall 30*a*, the cover 20 for the light blocking and the shield 28 for the same purpose, polyphenylene oxide resin, polycarbonate resin, ABS resin, metal and rubber which are opaque are suitable. In addition, transparent material is usable, if it absorbs or reflects the light of the wavelength to which the photosensitive layer of the photosensitive drum 3 is sensitive.

Figure 9:
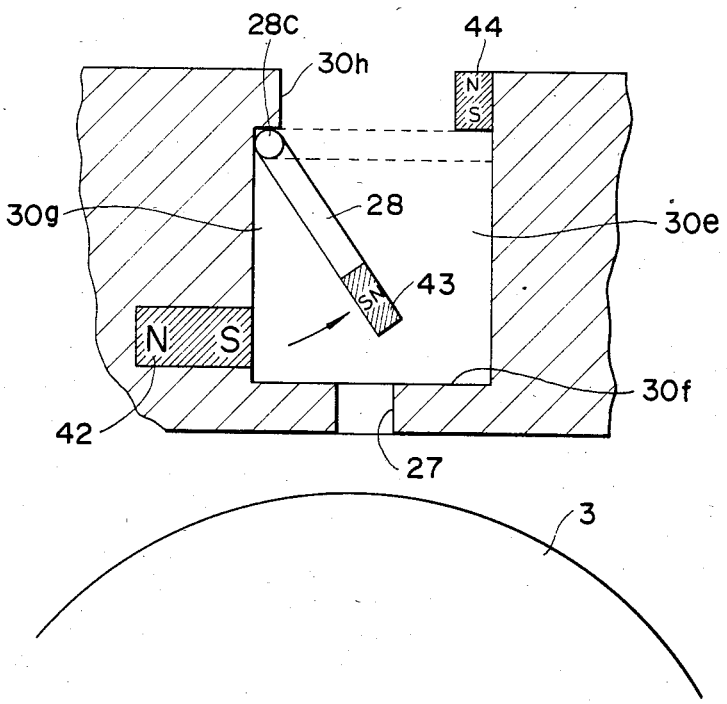
FIG. 9 shows a cross-section of another embodiment of the shielding mechanism.

FIG. 9 shows another embodiment of the present invention. In the foregoing embodiment, the shield 28 is urged by the spring 40. In the embodiment of FIG. 9, magnetic repelling and attracting forces are utilized, in place of the spring force. Otherwise, the structure of this embodiment is the same as the foregoing one. When the process unit 30 is taken out of the image forming apparatus body C, the shield 28 is released from the guiding projection 41 of the image forming apparatus C. Then, the shield 28 is raised by the repelling magnetic force between a magnet 43 provided on one end of the shield 28 and the magnet 42 provided on the lower side wall 30*g* portion of the recess 30*e*. The raised shield 28 is then lifted up by the magnetic attracting force between the magnet 43 and another magnet 44 provided adjacent to the opening 30*h*, to take its horizontal position, thus closing the aperture 27.

Figure 10B:
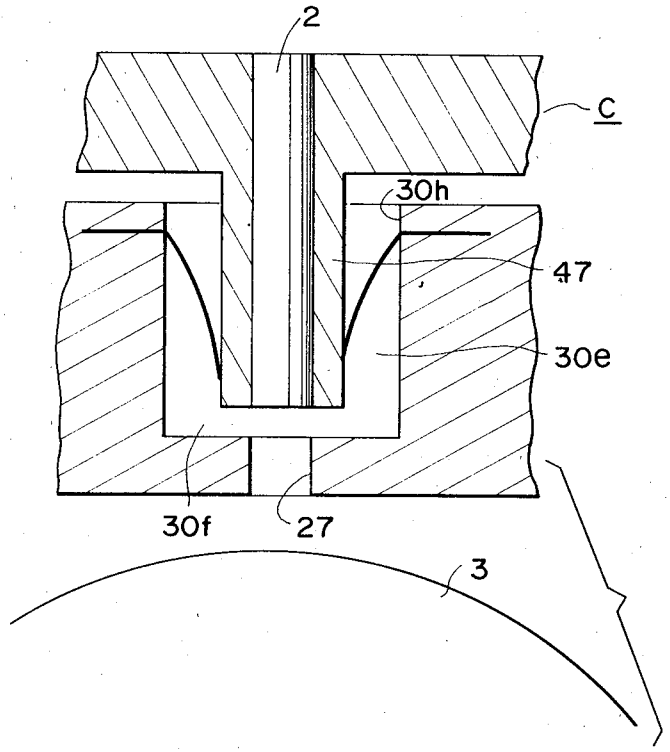
FIG. 10B shows a cross-section of the shielding mechanism of FIG. 10A in the opened state.
Figure 10A:
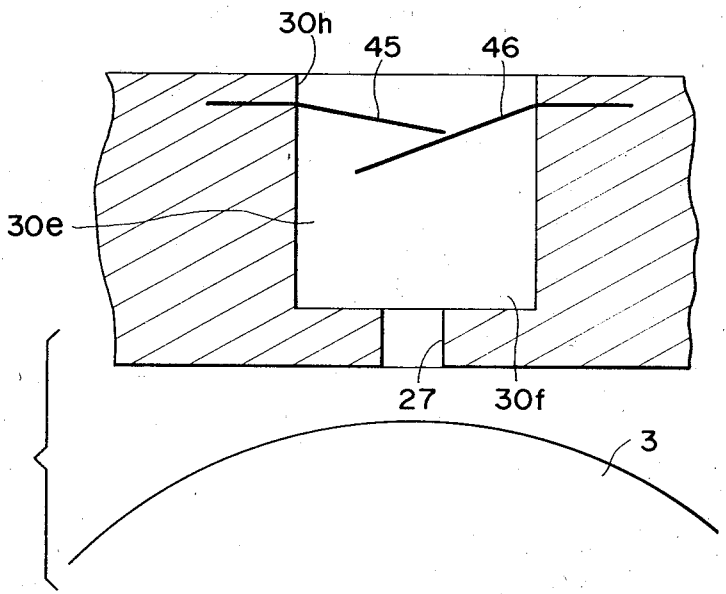
FIG. 10A shows a cross-section of a further embodiment of the shielding mechanism in the closed state.

FIGS. 10A and 10B show a further embodiment of the present invention, wherein the shield is formed by flexible shield plates 45 and 46 made of a flexible rubber sheet or a synthetic resin sheet which has a small surface friction coefficient and which can block the light of the wavelength to which the photosensitive drum 3 is sensitive. When the process unit 30 is out of the image forming apparatus body C, the shield plates 45 and 46 are partly overlapped to entirely cover the opening 30*h* above the image exposure aperture. 27 to prevent the light from entering the process unit 30, and therefore, reaching the photosensitive drum 3.

When, on the other hand, the process unit 30 is mounted in place in the image forming apparatus body C, the guide 47, provided on the image forming apparatus at a position opposing the aperture 27 when the unit is being set in, bends downwardly the shield plates 45 and 46 to open the shield, and the parts of the shield plates 45 and 46 which have been in the image forming apparatus body C are kept open by the array 2 of the imaging element, so that the light from the imaging element array 2 can reach the photosensitive drum 3.

In any of the foregoing embodiments, the guides 41 and 47 are provided at a front side of the apparatus so that they do not interfere with the aperture 27 of the process unit 30 when it is set in place.

Figure 11:
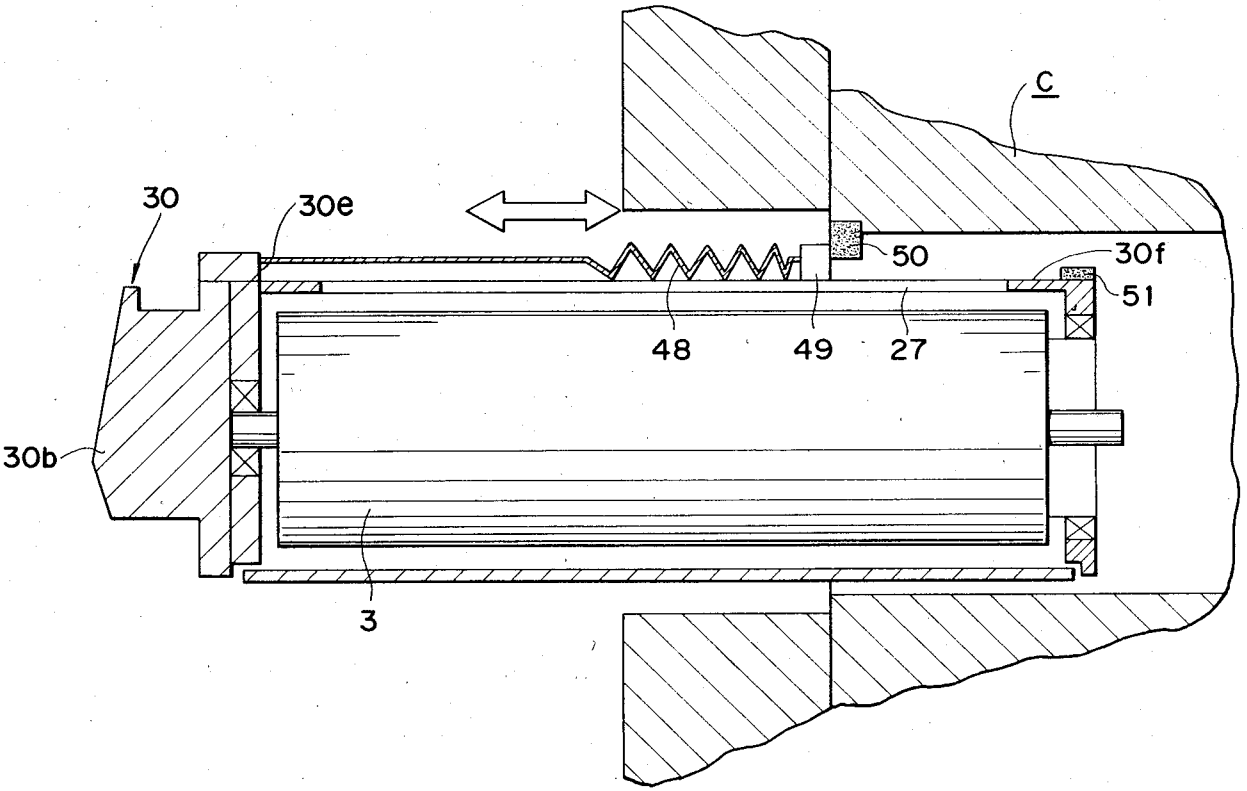
FIG. 11 shows a cross-section of a yet further embodiment of the shielding mechanism.

FIG. 11 illustrates a further embodiment of the present invention, wherein a side cross-section is shown. The shield 48 is of bellows structure. When the process unit 30 is out of the apparatus body C, the shielding bellows close the aperture 27 to prevent the light memory which otherwise occurs in the photosensitive drum 3 and to protect the photosensitive drum 3 from a possible damage. When the process unit 30 is brought into the apparatus body C, a member 49 of magnetic material mounted on an end of the shielding bellows 48 abuts the magnet stopper 50 of the apparatus body C. With the subsequent insertion of the process unit 30 into the apparatus body C, the magnetic member 49 slides above the aperture 27, and the shielding bellows contract to open the aperture 27.

When the process unit 30 is removed from the apparatus body C, the magnetic member 49 is kept contacting to the magnet stopper 50 by the magnetic force therebetween, so that the contracted bellows are expanded with the pulling-out of the process unit 30, until the magnetic member 49 is attracted to another magnet 51 fixed on the process unit 30 at an end thereof, thus locking the shield 48 at its closing position.

Figure 12:
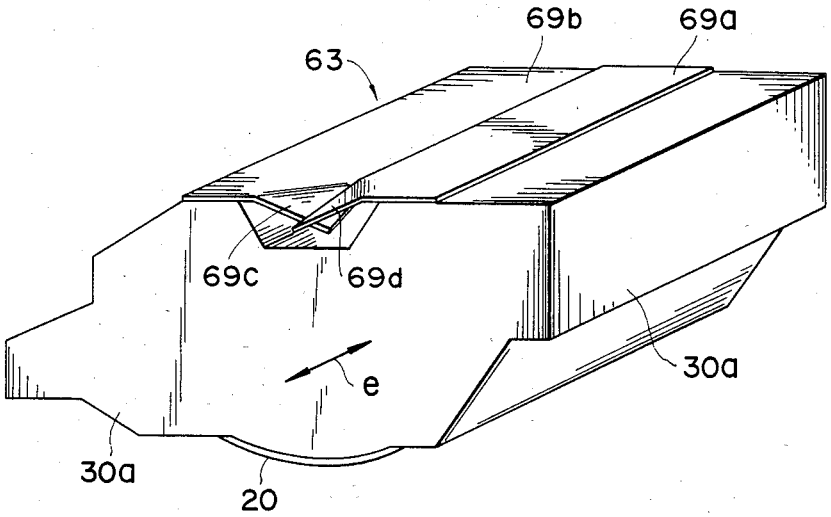
FIG. 12 is a perspective view of the process unit according to a further embodiment of the present invention.
Figure 13:
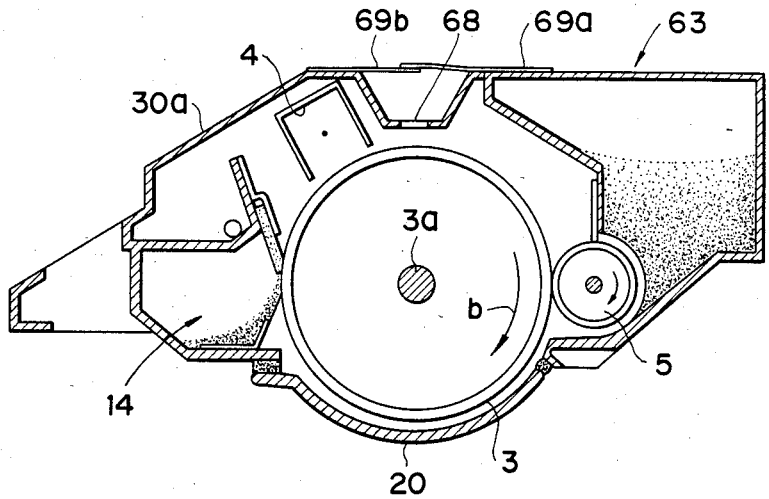
FIG. 13 shows a cross-section of the process unit of FIG. 12.
Figure 14:
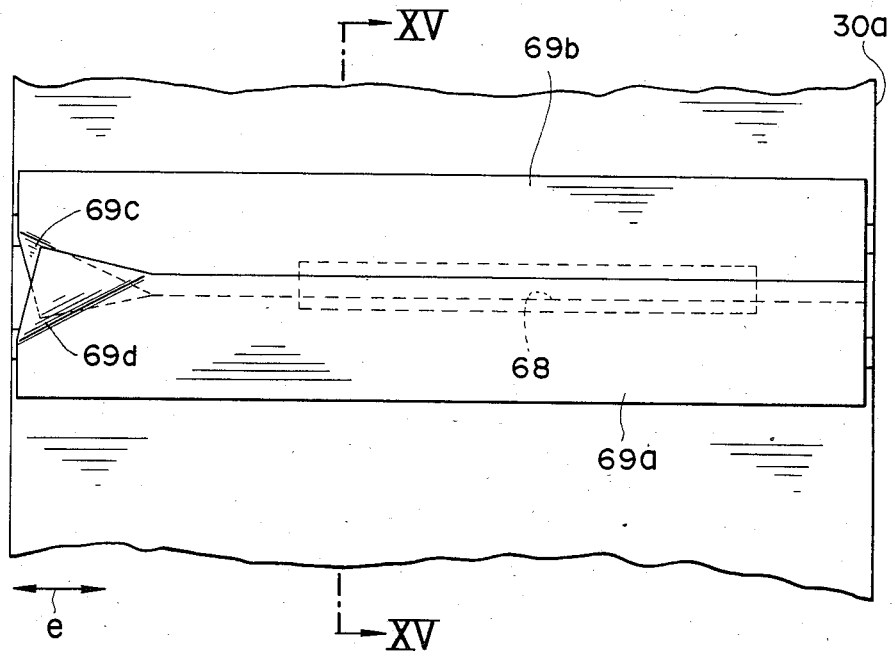
FIG. 14 is a plan view of a part of the process unit of FIG. 12.
Figure 15:
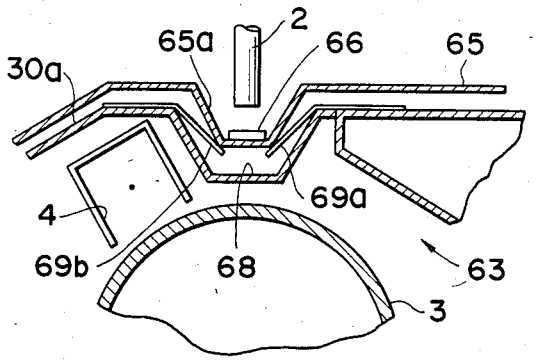
FIG. 15 is a cross-sectional view of a part of the process unit of FIG. 12, taken along lines XV—XV of FIG. 14.

FIGS. 12, 13, 14 and 15 illustrate a further embodiment of the present invention. FIG. 12 shows a perspective view of a process unit 63 to which the present invention is embodied. FIG. 13 is a cross-sectional view of the process unit 63 of FIG. 12. FIG. 14 is a plan view of the same process unit 63. FIG. 15 is a cross-sectional view of a part of the process unit 63 and a part of the image forming apparatus body C when the process unit 63 is set in place therein.

The process unit 63 is moved in the direction shown by arrow e, when it is inserted into the apparatus body C. To the upper part of the process unit 63, more particularly, above the image exposure aperture 68, two black flexible sheets 69*a* and 69*b* of a synthetic resin are bonded to the process unit 63. The unbonded parts of the sheets are partly overlapped to prevent the light from leaking into the process unit 63. For the facilitation of the insertion of the process unit 63 into the apparatus body C, which will be described hereinafter, ends of the sheet 69*a* and 69*b* are bent downwardly as shown by the reference numerals 69*c* and 69*d*. This will be clearly understood, referring to FIGS. 12 and 14. The sheets 69*a* and 69*b* are so shown that the sheet 69*a* is over the sheet 69*b*, but this may be inversed. The sheets 69*a* and 69*b* together completely cover the exposure aperture 68, and further they block the lateral light entering substantially completely by the bent portions 69*c* and 69*d*.

When the process unit 63 of this embodiment is brought into the apparatus body C, the concave-up portion 65*a* of the apparatus body C acts on the sheets 69*a* and 69*b*. The concave-up portion 65*a* is a part of the light blocking wall 65 of the process unit 63 and functions to support a dust proof glass 66 which protect from dust the imaging element array 2 which extends into the concave-up portion. Since the sheets 69*a* and 69*b* are of flexible material, they are bent by the concave-up portion 65*a*, as shown in FIG. 15. The concave-up portion 65*a* is long enough to cover the entire length of the sheets 69*a* and 69*b*, that is, it has the same length or longer, the portions which are bent with the insertion of the process unit 63, and upon setting the process unit 63 in place, the sheets 69*a* and 69*b*, over their entire length, are kept bent downwardly. Thus, the lateral end portions of the sheets 69*a* and 69*b* no longer overlapped, so that the aperture 68 is opened to allow the light image of the original to be copied to reach the photosensitive drum 3 surface.

When, on the other hand, the process unit 63 is taken out of the apparatus C, the sheets 69*a* and 69*b* restore their overlapping position because they are of flexible and resilient material. That is, with the pulling-out of the process unit 63, the sheets 69*a* and 69*b* are successively bent back to its original position, so that the sheets 69*a* and 69*b* take the closing position, as shown in FIG. 13.

The bent portions 69*c* and 69*d* of the respective sheets 69*a* and 69*b* are effective to make easier the initial bending of the sheets by the concave-up portion 65*a* upon insertion of the unit.

The part of the optical means which acts on the sheets 69*a* and 69*b* is the wall constituting a part of the image exposure optical system in the embodiment. This is not limiting, but the array 2 itself, a support for the array or a support for the light source may be used. Therefore, a structure for the optical means actable on the process unit may be usable.

As described in detail in the foregoing, the process unit is provided with a shielding cover which automatically opens and closes the aperture of the process unit in response to the insertion into and pulling out of, the image forming apparatus body C, respectively, thus ensuring the protection of the photosensitive drum from the deterioration by the external light and from the possibility of the mechanical or physical damage thereto.

Although the foregoing explanations have been made with the embodiments wherein the process unit is completely taken apart from the image forming apparatus body C, the present invention is applicable to the case where the unit can be partly drawn out but cannot be pulled apart. The shield or light blocking assembly is applicable not only to the image exposure aperture but also to an aperture for the pre-exposure or an aperture for the whole surface exposure which may be preferable or necessary because of peculiarity of the image forming process used, and also applicable to an aperture for a blank exposure, as the case may be.

The foregoing embodiments employ the image bearing members having an organic photoconductor, selenium (Se) or a zinc oxide photoconductor, but the materials are not limiting, and other photosensitive layers may be used. Additionally, the present invention is not limited to the case where the image bearing member has a photosensitive layer, but the image bearing member can be an insulating member, in which the main purpose of the cover is the protection from the mechanical or physical damage. The image bearing member is not limited to a drum or cylinder type, but it may be of an endless belt entrained on pulleys.

The developing method is not limiting, either. It may be magnetic brush development, cascade development, fur brush development, powder cloud development or other types of development.

The method or mechanism of the cleaning of the image bearing member is not limited to the blade cleaning, but fur brush cleaning, roller cleaning or web cleaning is usable.

The imaging element is not limited to the array of the small diameter imaging elements each having a relatively short focal length. It may be an ordinary imaging lens or bar lenses.

The image forming process is not limiting. It may be a so-called Carlson process, NP process (USP 3666363) or PIP (Persistent Internal Polarization) process.

Figure 16A:
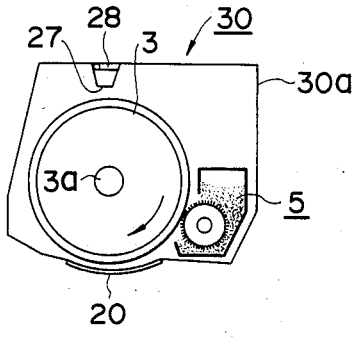
FIGS. 16A, 16B, 16C and 16D show cross-sections of the process units of different types according to the present invention.
Figure 16B:
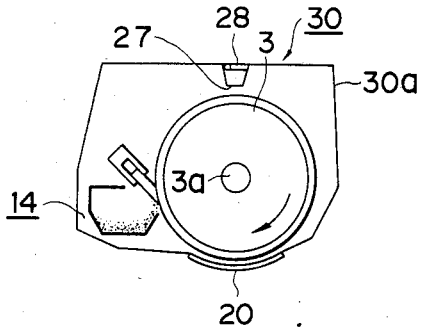
Figure 16C:
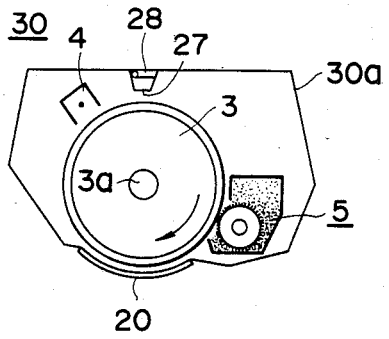
Figure 16D:
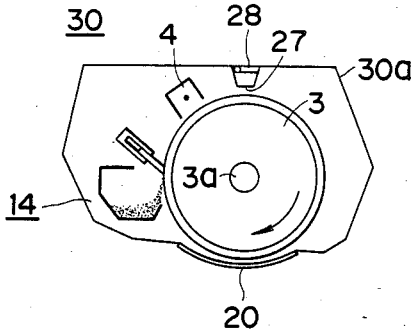

Although the foregoing embodiments of the present invention include the process unit which contains not only the photosensitive drum but also a developing device, cleaner and charger, as the process means, the present invention is not limited to this arrangement. For example, as shown schematically in FIGS. 16A, 16B, 16C and 16D, the process unit 30 may contain as a unit the developing device 5 and photosensitive drum 3, as the process means (FIG. 16A); may contain as a unit the cleaner 14 and photosensitive drum 3, as the process means (FIG. 16B); may contain as a unit the charger 4, developer 5 and photosensitive drum 3 (FIG. 16C); or may contain as a unit the charger 4, cleaner 14 and photosensitive drum 3 (FIG. 16D). As described hereinbefore the image bearing member is not limited to photosensitive drum. The process unit, therefore, may contain only a part or all of the process means. The process means actable on the image bearing member, in the foregoing embodiments, are the array of the imaging elements, corona charger, developer, transfer corona discharger, sheet separating means and cleaner.

The image bearing member or another part of the process unit may be constructed as being detachable from the unit.

According to the present invention, as described above, the image bearing member can be surely protected by a shield or shields preventing the deterioration of or damage to the image bearing member.

While the invention has been described with reference to the embodiments disclosed herein, it is not confined to the details set forth and the present application is intended to cover such modifications or changes as may come within the spirit of the improvements or the scope of the claims.

What is claimed is:

1. A process unit detachably mountable to a predetermined portion of a main assembly of an image forming apparatus, comprising:

an image bearing member including a photosensitive member;

process means actable on said image bearing member;

a casing having an exposure opening for allowing light to reach said image bearing member from outside thereof, said exposure opening being formed in a recessed portion of said casing;

a protection cover for operably closing the exposure opening of said casing to protect said image bearing member; and means for supporting said protection cover for movement between a closing position wherein it closes the exposure opening and a retracted position wherein it is retracted from the closing position, said protection cover being adapted to be moved, when said process unit is mounted to the predetermined portion of the main assembly, by a member of the main assembly disposed adjacent an optical system of the main assembly, and adapted to be aligned with the exposure opening of said casing when said process unit is mounted to the predetermined portion of the main assembly, from the closing portion to the retracted position, said cover being opened toward said image bearing member and being in the recess when it is in the retracted position.

2. A unit according to claim 1, wherein the member adjacent said optical system is a supporting member for an array of lenses.

3. A unit according to claim 1, wherein the member adjacent said optical system is a wall for protecting an array of lenses.

4. A unit according to claim 1, wherein said protection cover is of resilient material.

5. A unit according to claim 1, wherein said protection cover is a plate-like member.

6. An apparatus according to claim 1, wherein the member adjacent said optical system is a supporting member for an array of lenses.

7. An apparatus according to claim 1, wherein the member adjacent said optical system is a wall for protecting an array of lenses.

8. An apparatus according to claim 1, wherein said protection cover is opened when said process unit is mounted to the predetermined portion of the main assembly.

9. A unit according to claim 1, wherein said cover is effective to shield said image bearing member from external light.

10. A unit according to claim 1, wherein said process means further contains an image developing device.

11. A unit according to claim 1, wherein said process means includes a cleaning device.

12. A unit according to claim 1, wherein said process means includes an image transferring charger.

13. A unit according to claim 1, wherein said process means includes an electric charger and a developing device in said unit.

14. A unit according to claim 1, wherein said process means includes an electric charger and a cleaning device in said unit.

15. An image forming apparatus, comprising:

a process unit detachably mountable to a predetermined portion of main assembly of said image forming apparatus including an image bearing member including a photosensitive member; process means actuable on said image bearing member; a casing having an exposure opening for allowing light to reach said image bearing member from outside thereof, said exposure opening being formed in a recessed portion of said casing; a protection cover for operably closing the exposure opening of said casing to protect said image bearing member; and means for supporting said protection cover for movement between a closing position wherein it closes the exposure opening and a retracted position wherein it is retracted from the closing position, said cover being opened toward said image bearing member and being in the recess when it is in the retracted position; and a member disposed adjacent an optical system of the main assembly and provided in the main assembly and adapted to be aligned with the exposure opening of said casing, which is effective, when said process unit is mounted to the predetermined portion of the main assembly, to move said protection cover from the closing position to the retracted position.

16. An apparatus according to claim 15, wherein said protection cover is a plate-like member.

17. An apparatus according to claim 15, wherein said protection cover is opened in relation to an action of mounting the process unit to the predetermined portion of the main assembly.

18. An apparatus according to claim 17, wherein said protection cover is of resilient material.

19. An image forming apparatus, comprising:

a process unit detachably mountable to a predetermined portion of a main assembly of said image forming apparatus including a photosensitive member; process means actuable on said image bearing member; a casing having an exposure opening for allowing light to reach said photosensitive member from outside thereof, said exposure opening being formed in a bottom of a recess portion of said casing; a protection cover for closing the exposure opening of said casing to protect said photosensitive member; and means for supporting said protection cover for movement between a closed position wherein it closes the exposure opening and a retracted position wherein it is retracted from the closed position; and an optical element provided in said main assembly and having an end portion which is in the recess of said casing with said opening being opened, when said process unit is mounted in said main assembly.

20. An apparatus according to claim 19, wherein said optical element is an array of imaging optical elements.

21. An apparatus according to claim 19, wherein said optical element includes dust proof glass.

* * * * *

UNITED STATES PATENT AND TRADEMARK OFFICE

CERTIFICATE OF CORRECTION

PATENT NO. : 4,588,280

DATED : May 13, 1986

INVENTOR(S) : OGAWA, ET AL.

It is certified that error appears in the above-identified patent and that said Letters Patent is hereby corrected as shown below:

AT [57] IN THE ABSTRACT

Line 6, "member a" should read --member, a--.

COLUMN 1

Line 46, "replace to use" should read --substituted to permit use of--.

COLUMN 4

Line 7, "drum 30" should read --drum 3--.
Line 16, "drum 30" should read --drum 3--.
Line 19, "drum 30" should read --drum 3--.

COLUMN 5

Line 19, "imaq.e" should read --image--.

COLUMN 6

Line 29, "aperture 23" should read --aperture 27--.
Line 35, "enter, through" should read --enter through--.

COLUMN 7

Line 27, "aperture. 27" should read --aperture 27--.

COLUMN 8

Line 32, "dust proof" should read --dustproof--.
Line 38, "it has" should read --it is--.

UNITED STATES PATENT AND TRADEMARK OFFICE

CERTIFICATE OF CORRECTION

PATENT NO. : 4,588,280

DATED : May 13, 1986

INVENTOR(S) : OGAWA, ET AL.

It is certified that error appears in the above-identified patent and that said Letters Patent is hereby corrected as shown below:

COLUMN 8

Line 39, "or longer," should read --or is longer than--.

Line 52, "its" should read --their--.

COLUMN 10

Line 40, "portion" should read --position--.

COLUMN 11

Line 16, "actuable" should read --actable--.

COLUMN 12

Line 15, "actuable" should read --actable--.

Signed and Sealed this

Fourteenth Day of April, 1987

*Attest:*

DONALD J. QUIGG

*Attesting Officer*

*Commissioner of Patents and Trademarks*